US005564125A

United States Patent [19]

Waldman et al.

[11] Patent Number: 5,564,125

[45] Date of Patent: Oct. 15, 1996

[54] COMBINATION OUTERWEAR GARMENT AND CARRIER PACK

[75] Inventors: Rhoda M. Waldman; Donald Waldman, both of Golden, Colo.

[73] Assignee: Concepts Continental, Inc., Golden, Colo.

[21] Appl. No.: 326,538

[22] Filed: Oct. 20, 1994

[51] Int. Cl.[6] ..... A41D 15/00

[52] U.S. Cl. ..... 2/93; 2/94; 224/576; 224/577; 224/586; 224/683

[58] Field of Search ..... 2/93, 94; 224/151, 224/224, 240; 383/4

[56] References Cited

U.S. PATENT DOCUMENTS

| | | | |
|---|---|---|---|
| D. 261,196 | 10/1981 | Griffin | D2/383 |
| 1,927,751 | 9/1933 | Mensi | 128/258 |
| 2,292,347 | 8/1942 | Bailey | 383/4 X |
| 2,334,061 | 11/1943 | Berkman | 2/88 |
| 3,085,254 | 4/1963 | Cutler | 2/243 |
| 3,670,340 | 6/1972 | Walker | 2/93 |
| 4,029,243 | 6/1977 | Zerobnick et al. | 224/8 |
| 4,217,663 | 8/1980 | Goldberg et al. . | |
| 4,244,499 | 1/1981 | Adams | 224/224 |
| 4,404,687 | 9/1983 | Hager | 2/94 |
| 4,518,107 | 5/1985 | Amos | 224/215 |
| 4,523,703 | 6/1985 | McKenna | 224/224 |
| 4,862,519 | 8/1989 | Bull | 224/224 X |
| 5,003,634 | 4/1991 | Brinkman | 224/224 X |
| 5,040,243 | 8/1991 | Tatsuno | 2/108 |
| 5,077,838 | 1/1992 | Senser | 2/69 |
| 5,165,111 | 11/1992 | Lieberman . | |
| 5,407,112 | 4/1995 | Christodoulou et al. | 2/94 X |
| 5,452,476 | 9/1995 | Jenks | 2/93 X |

FOREIGN PATENT DOCUMENTS

| | | | |
|---|---|---|---|
| 1434108 | 3/1962 | France | 2/94 |

*Primary Examiner*—C. D. Crowder
*Assistant Examiner*—Shirra L. Jenkins
*Attorney, Agent, or Firm*—Donald W. Margolis; John L. Isaac

[57] ABSTRACT

A combination carrier pack and single upper torso outerwear garment is disclosed and taught. A pack member is provided to be secured around the mid-section of a person. The pack has a front portion, a back portion, first and second opposed end portions, and a closeable compartment defined therewithin. A mechanism for releasably closing and opening the compartment is also provided. A single upper torso outerwear garment is integrally connected within the closeable compartment of the pack. In order to be worn around the mid-section of a person, a belt member is associated with the first and second opposed end portions of the pack. In preferred embodiments, the belt members include interconnecting fastening mechanisms at their distal ends for size adjustment, and for removable attachment of the pack about the mid-section of a person. This combination allows the single upper torso outerwear garment which is integrally connected within the closeable compartment of the pack to enable the pack and belt members to releasably secure the garment about the mid-section of a person when the garment is worn by that person. This combination further enables the garment to be folded into the closeable compartment of the pack for storage to be carried in the pack about the mid-section of a person when the garment is not being worn by that person.

23 Claims, 3 Drawing Sheets

COMBINATION OUTERWEAR GARMENT AND CARRIER PACK

BACKGROUND OF THE INVENTION

1. Field of the Invention

This invention relates generally to body garments and combined carriers for such garments. More specifically, the present invention relates to a combination upper torso outerwear body garment and carrier therefor.

2. Description of the Prior Art

When one is in an outdoor environment it is often highly desirable, especially when the weather conditions change unexpectedly, to have ready access to an upper torso outerwear garment such as a jacket, a wind breaker, a poncho, a rain coat, or the like. However, people tend to dress according to the weather conditions at the start of an outdoor excursion, and do not always take the garment that they need. So, for example, if the weather is fair and warm, a person will tend to not wear an upper torso outerwear garment. Should the weather subsequently become cold or stormy, the person will want to be able to easily and conveniently put on an outerwear garment for warmth or protection, and to avoid the possibility of succumbing to hypothermia. Consequently, convenient and ready accessibility to such outerwear garments is highly desirable. Conversely, a person may start an outdoor excursion wearing an outerwear garment, and, should the weather subsequently become warm or the precipitation end, the person will want to be able to easily and conveniently remove the outerwear garment and store it neatly and safely away without having to carry it by hand, or in cumbersome separate bags, pouches, or the like.

Numerous attempts have been made in the prior art to provide outer wear garments having self-contained carrier pockets or similar type of self-containment members, such as those taught in U.S. Pat. Nos. 2,334,061; 3,085,254; and 5,077,838. In each of these references, the individual is required to carry a separate pack or pouch which houses the outerwear garment when the garment is not being worn.

A popular type of carrier pack, commonly referred to as a "fanny pack", is particularly convenient for activities where unencumbered, hands free, outdoor movement is desired. These packs are generally carried along the lower back, front or side of the mid-section of an individual, and are held, for example, by an adjustable belt. Common designs provide a pack of generally uniform cross-section, with access to a storage compartment by one or more zippers. Examples of such packs include U.S. Pat. Nos. 4,029,243; 4,244,499; 4,518,107; 4,523,703 and Design Patent 261,197. U.S. Pat. No. 4,523,703, specifically notes that, because of the bulk and length of coats and jackets, that prior art fanny pack designs have a poor capability to accommodate them. U.S. Pat. No. 4,523,703 attempts to overcome this problem by providing a separate, tubular-shaped fanny pack having side openings which are designed to permit storage of a separate bulky object such as a coat or jacket. Unfortunately, such a carrier pack cannot effectively function in any capacity other than to carry a coat. Moreover, in the latter reference the coat is entirely separate from the pack. U.S. Pat. No. 4,518,107 discloses a flexible carrier system for ski equipment which, in one embodiment, is connected within a closable fanny pack.

In addition to the above stated problem of utilizing carrier packs with existing coats or jackets, an individual user must remember to carry both the pack and the upper torso outerwear garment prior to venturing out of doors. As a result, if one inadvertently forgets to pack the carrier with an appropriate outerwear garment, obviously such garment is not available for later use. Moreover, if one starts out wearing the garment, but forgets the carrier, or packs the carrier with other items without leaving sufficient storage room for the garment, the garment may not be stored in the carrier. One solution to this problem is illustrated in U.S. Pat. No. 5,040,243 which discloses a main upper torso body garment having a built-in mid-section carrier which contains an integrally attached, full, second upper torso body outerwear garment. One short coming of this reference is that a user must have a need to wear the main garment in order to be able to have ready access to the secondary or outermost garment. Without such a need, the entire unit will have to be separately stored and carried. An additional short coming of this reference is that the two garments are always combined, and that a user does not have the option of carrying and using the secondary garment separate from the main garment. Thus, there remains a need for a lightweight carrier system which is easy to use and multi-functional, and which is designed to incorporate and integrally carry a single outerwear garment.

SUMMARY OF THE INVENTION

Accordingly, it is one object of the present invention to provide a combination outerwear garment and carrier therefor.

Another object of the present invention is to provide a lightweight and comfortable combination single outerwear garment and carrier which is adapted to be worn about the mid-section of a user whether the garment is in a worn or a stored position.

Yet another object of the present invention is to provide a single upper torso outerwear garment with an integral storage container therefor in the form of a small, lightweight carrier pack combination.

In accordance with the above and other objects and advantages of the present invention, a combination carrier pack and single upper torso outerwear garment is disclosed and taught. A pack member is provided to be secured around the midsection of a person. The pack has a from portion, a back portion, first and second opposed end portions, and a closeable compartment defined therewithin. A mechanism for releasably closing and opening the compartment is also provided. A single upper torso outerwear garment is integrally connected within the closeable compartment of the pack. In order to be worn around the mid-section of a person, a belt member is associated with the first and second opposed end portions of the pack. In preferred embodiments, the belt members include interconnecting fastening mechanisms at their distal ends for size adjustment, and for removable attachment of the pack about the midsection of a person. This combination allows the single upper torso outerwear garment which is integrally connected within the closeable compartment of the pack to enable the pack and belt members to releasably secure the garment about the mid-section of a person when the garment is worn by that person. This combination further enables the garment to be folded into the closeable compartment of the pack for storage to be carried in the pack about the mid-section of a person when the garment is not being worn by that person. These and other objects of the present invention will become apparent to those skilled in the art from the following detailed description, showing the contemplated novel construction, combination, and elements as herein described, and more particularly defined by the appended claims, it being understood that changes in the precise embodiments of the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENTS

Referring initially to FIGS. 1–4, a combination carrier pack and outerwear garment device, generally 10 is disclosed and includes a carrier pack member 12 having a single outerwear garment 14 integrally associated therewith. In the preferred embodiment which is shown, the outerwear garment is a hooded jacket. However, as used herein, the term "outerwear garment" shall be understood to be any upper torso garment, such as a jacket, a wind breaker, a coat, a raincoat, a poncho, and the like.

Figure 7A:
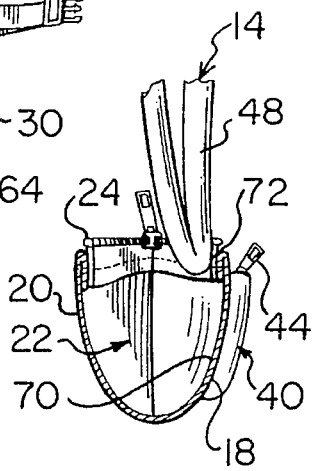
FIG. 7A is a partial cross-sectional view taken along line 7A—7A of FIG. 7, and illustrating, in particular, the integral attachment between the outerwear garment and the carrier pack.
Figure 7:
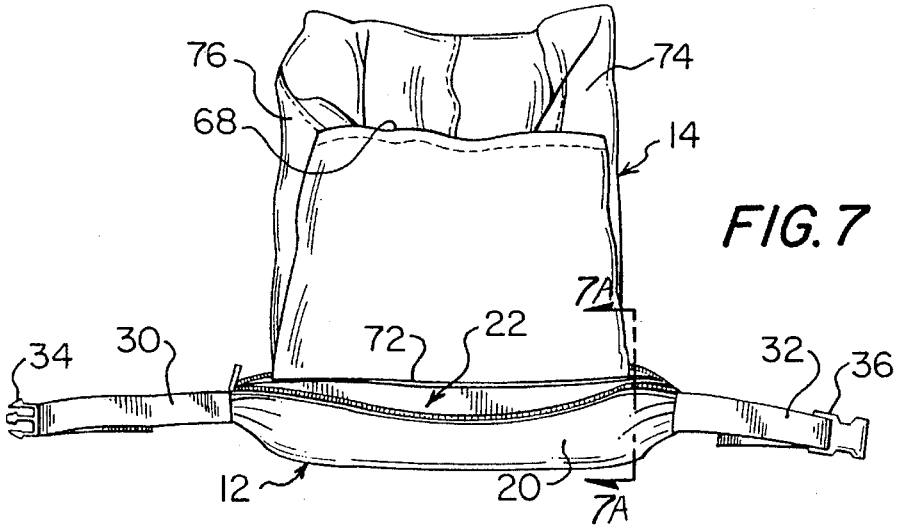
FIG. 7 is a view similar to that of FIG. 6 illustrating a further folded position of the outerwear garment for storage within the carrier pack.

The carrier pack 12 includes a main body portion 16, a front surface 18 and a back surface 20 (FIGS. 6–9) which together define an interior main compartment 22 (FIG. 7). The main body portion 16 may be constructed from a single sheet of material folded on itself, or from multiple panels cut to size and sewn or otherwise connected together, as is known in the art. The main compartment 22 includes a closure mechanism 24 that is adapted to open and close compartment 22 for access thereto. The closure mechanism may be of any desired type of closure such as a zipper, hook and loop closure material, buckles, snaps, buttons, laces, and the like. In the preferred illustrated embodiment, the closure mechanism 24 is in the form of a zipper. As used herein, the term "carrier pack", or "carrier pack member", or "pack" or "fanny pack" shall all be understood to mean a small pack having an interior compartment and designed to be carried around the midsection of a person by a belt. In no instance shall the term "carrier pack" or "pack" or "fanny pack" mean another garment.

The main body 16 of pack 12 includes first and second opposed external end portions 26 and 28. A pair of length adjustable belt members 30 and 32 having their proximal ends secured to end portions 26 and 28, respectively. In the embodiment shown, the free or distal end of the belt 30 includes a first fastening member 34 which is releasably engagable with a second fastening member 36 disposed on the free or distal end of the belt member 32. In this manner, the pack member 12 with the belts 30 and 32 may be adjustably engaged about the mid-section of a person 38 in a typical "fanny pack" attachment position. It is to be understood that other art known belt members may be used for the same purpose. For example, a single piece belt which is threaded through end portions 26 and 28, and through the body of the pack may be used instead of two separate belt portions 30 and 32. Similarly, the pack 12 may have a mechanism for detachably receiving belt members 30 and 32, or for detachably receiving some other belt system.

In the preferred and illustrated embodiment, a secondary compartment 40 is present. Compartment 40 may be formed, for example, from a web of material 42 secured to the front surface 18 of the main body 16 of pack 12. In such an embodiment, second closure mechanism 44 is provided at the upper surface of the web 42 to provide access to the secondary compartment 40. The secondary compartment 40 is utilized, generally, for the storage of miscellaneous items, while the primary or main compartment 22 of the main body 16 is utilized to store the outerwear garment 14 when it is not being worn by a person 38. Of course, the main compartment 22 may also be utilized, as desired, and space permitting, to store other items in addition to the garment 14.

Figure 3:
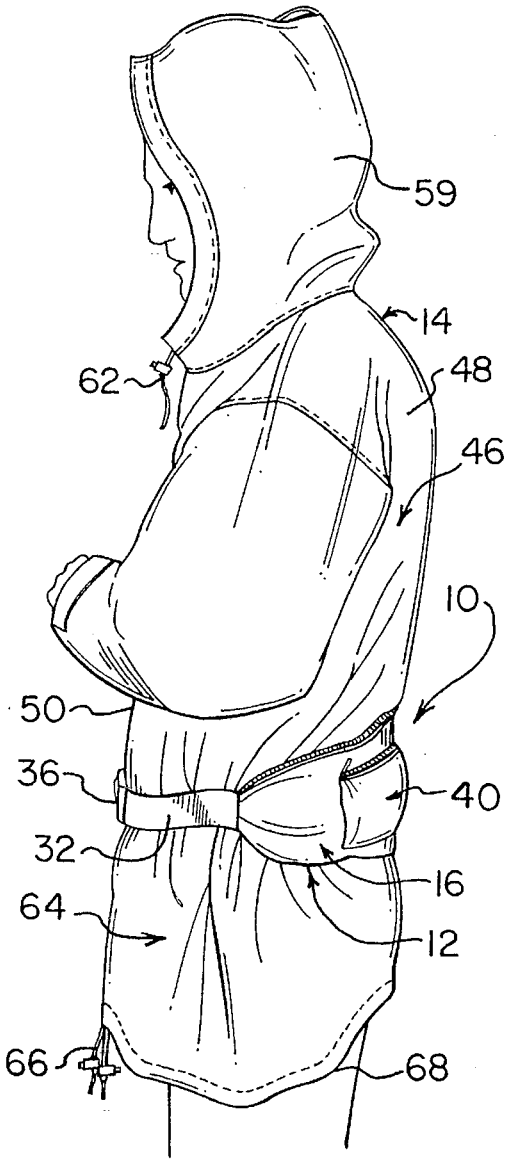
FIG. 3 is a perspective view schematic similar to that of FIG. 2, but illustrating the outerwear garment in an extended condition worn by a person, and with the carrier pack secured about the mid-section of the person.
Figure 4:
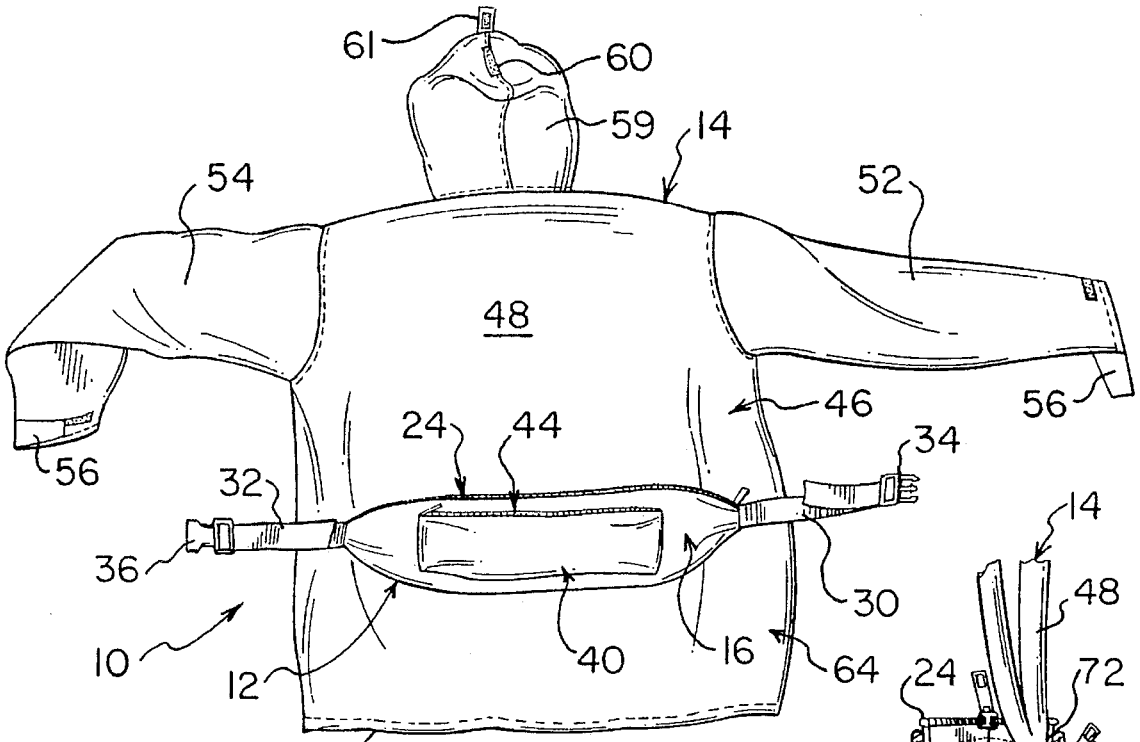
FIG. 4 is a rear perspective view of the carrier pack of FIG. 1 with the outerwear garment an extended position.

In the preferred embodiment shown, and visible in FIG. 3, outerwear garment 14 includes a main body portion 46 having a back panel 48 and a front portion 50. The outerwear garment 14 may be of any desired type and may be made from any flexible material. The flexible material may be air permeable material, or air impermeable material, and/or waterproof material. Nylon is one preferred, but nonlimiting material. In the latter instance, the outerwear garment may function as either a raincoat or as a wind breaker, depending on the desired environment with which the garment 14 is designed to be utilized. In the illustrated embodiment, the garment 14 includes a pair of sleeves 52, 54, each of which preferably includes a sleeve adjustment device 56 at the outermost end thereof. The front panel 50 of the garment 14 can be opened and closed by a fastener 58 (FIG. 5), such as a zipper, or may be of a pullover or poncho design, as desired. Where a closure is utilized, any desired art known form of closure may be used.

In the illustrated preferred embodiment, a hood 59 is provided for covering the head of a person 38. Hood 59 includes a latching mechanism 60 and an associate catch 61 for use in pulling the hood 59 tightly about the face of a user 38. Also shown in this preferred form, garment 14 includes a lower body portion 64 which extends below the mid-section, and over the hips of user 38. An art known draw string tightening member 66 is also provided at the bottom edge, and may, if desired, be used to secure bottom edge 68 of the lower portion 64 firmly about the hips of user 38.

As discussed above, the outerwear garment 14 is integrally associated with the carrier pack 12. In this manner, a single combination outerwear garment 14 and carrier 12 is created in which the belt 30 and 32 of the pack 14 also serves as the belt of garment 14 when it is being worn.

In the preferred embodiment, the single outerwear garment 14 is integrally associated with the carrier 12 by securing the outer surface of the back panel 48 of the garment 14 to the inner surface of the compartment 22. Referring in particular to FIGS. 7 and 7A, the main compartment 22 includes an interior rear surface 70 which forms a portion of the back 20 of carrier member 12. The outer surface 71 of the back panel 48 of the garment 14 is attached directly to the inner surface 70 of the main compartment 22 toward the upper portion thereof proximate to the closure 24. The manner of attaching the two components can be by any desired type of attachment mechanism, such as stitching, or bonding, although the use of snaps, hooks, laces, zippers, hook and loop material, and by other art known connecting means may be used. In the illustrated and preferred form, the back panel 48 is stitched or bonded directly to the inner surface 70 along the upper portion thereof at 72. This bonding or stitching 72 takes place along a substantial portion of the entire width of the main compartment 22 so as to maximize the area of bonding or attachment between the garment 14 and the carrier member 12.

When the body of garment 14 is removed from within the compartment 22 and positioned on the user 38 as illustrated in FIG. 3, the carrier 12 remains integrally joined and secured to the back side 20 of garment 14 in such a manner as to continue to maintain the second compartment 40 for ready access thereof. Moreover, in this manner the belt members 30 and 32 can be secured about the mid-section of the user 38 after the garment 14 has been positioned on the user 38 so as to serve as a belt for the garment 14. This provides several distinct advantages. First of all, the carrier 12 with belt members 30 and 32 secured in place will securely hold the coat or jacket 14 about the user 38. Moreover, this arrangement will provide wind and weather protection by closing the garment 14 about the mid-section of the user 38 so that neither wind nor cold air can migrate around the upper body portion of the user 38, the garment 14 being essentially sealed at the mid-section of the user 38. In addition, the ties or cords 66 at the lower edge 68 of the garment 14 can be tied tightly about the hips of the user 38 so as to isolate the air space between the belts 30 and 32 and the lower cords 66, thereby providing further insulation and warmth to the body of user 38.

Figure 1:
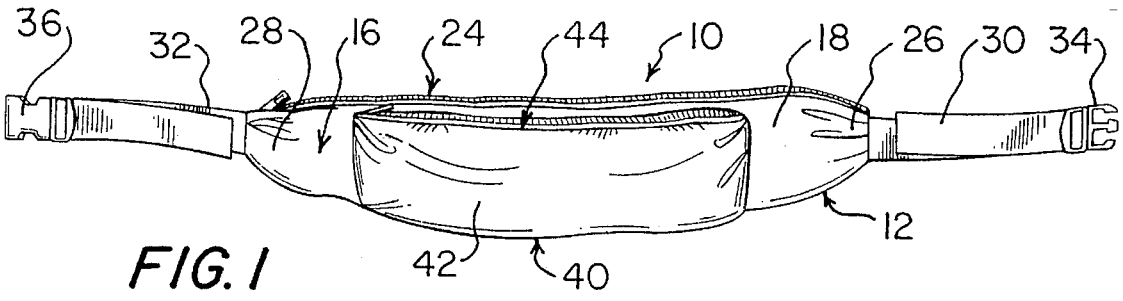
FIG. 1 is a rear perspective view of the carrier pack combination of the present invention with the single outerwear garment in a stored condition.
Figure 2:
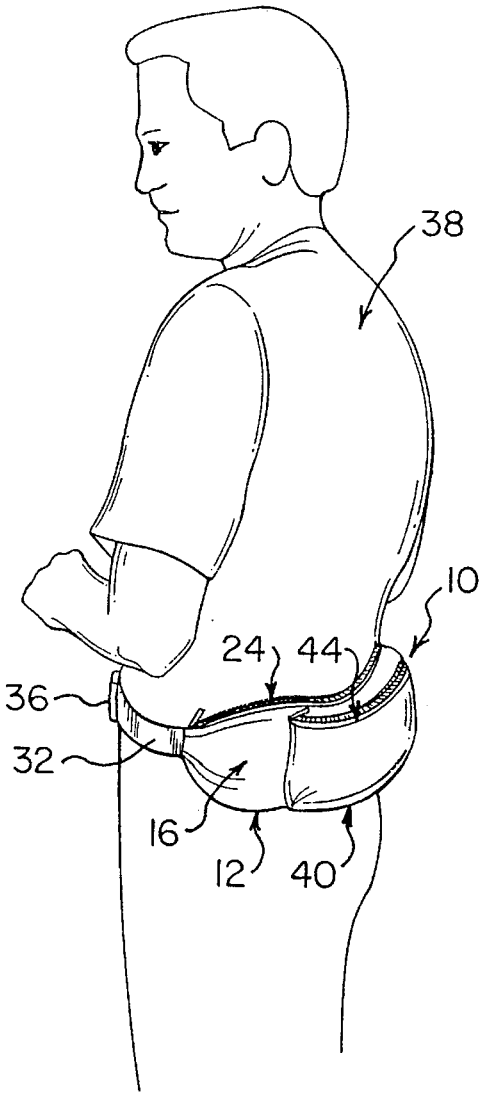
FIG. 2 is a side perspective view illustrating the carrier pack of FIG. 1 secured about the mid-section of a person, and with the outerwear garment in a stored condition.
Figure 5:
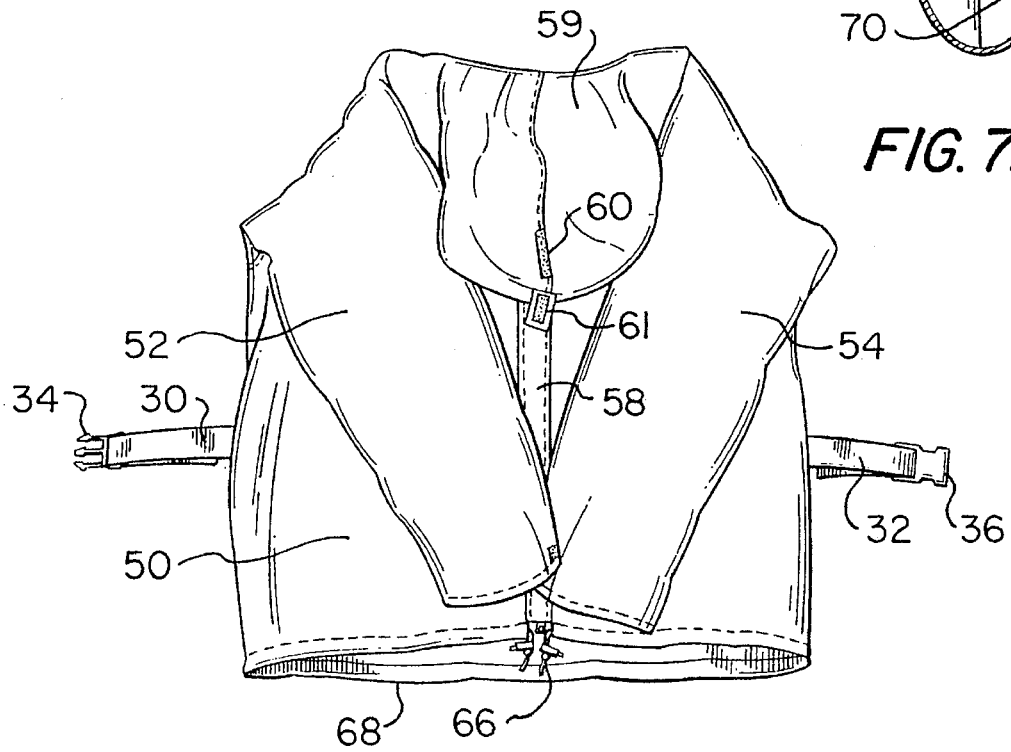
FIG. 5 is a front perspective view of the carrier pack and garment of FIG. 4 illustrating the initial hood and arm folding position of the outerwear garment as it is being prepared for storage within the carrier pack.
Figure 6:
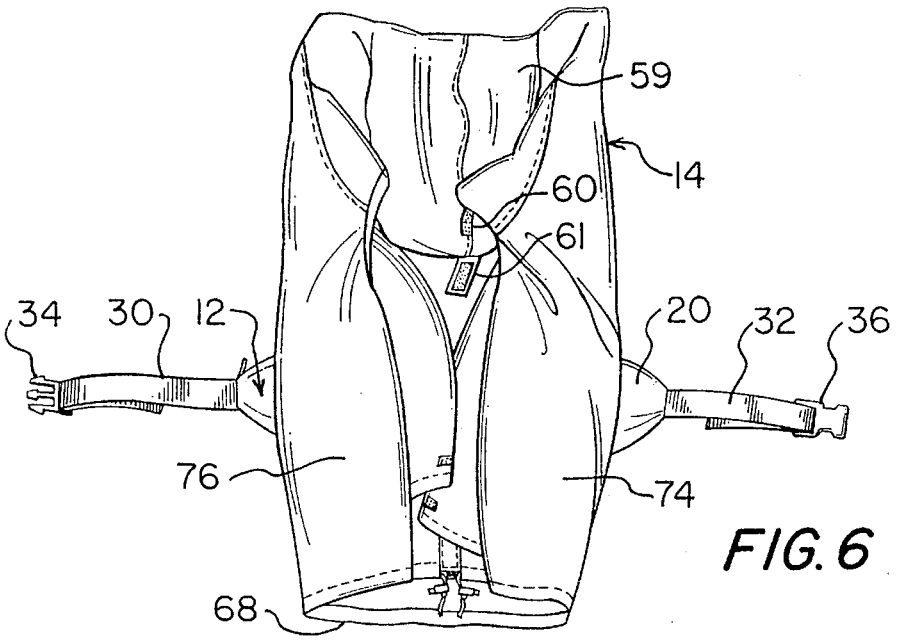
FIG. 6 is a view similar to that of FIG. 5 illustrating a further folded condition of the outerwear garment as it is prepared for storage within the carrier pack.
Figure 8:
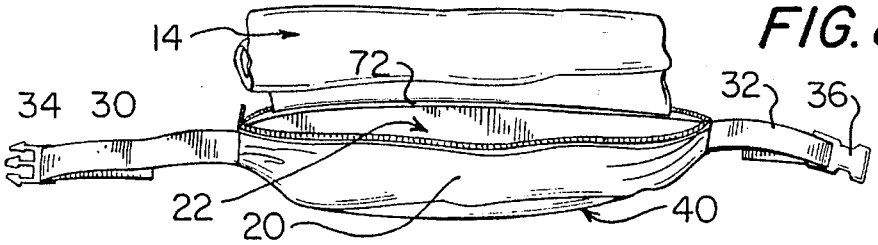
FIG. 8 is a view similar to that of FIG. 7 and illustrating yet a further folded or rolled position of the outerwear garment for placement within the carrier pack.
Figure 9:
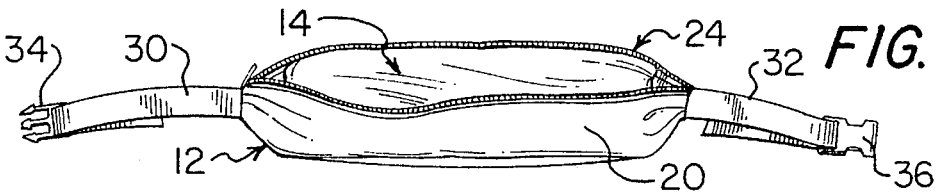
FIG. 9 is a view similar to that of FIG. 8 illustrating the outerwear garment fully folded and positioned within the internal compartment of the carrier pack, with the closure mechanism of the compartment in an open position.

Referring now to FIGS. 5–9, when its desired to store the garment 14 within the carrier 12, belt members 30 and 32 are released at fastening members 34 and 36, the garment 14 is removed from the person 38 and laid with its back side panel 48 down. The arms 52, 54 and the hood 60 are then folded inwardly toward the front portion 50 of the garment 14 as illustrated in FIG. 5. The sides 74, 76 are then folded further inwardly as illustrated as in FIG. 6 so as to reduce the width dimension of the garment 14 to be less than the width dimension of opening of compartment 22 of carrier 12. The lowermost edge 68 of the garment 14 is then folded upwardly toward the hood 60 as illustrated in FIG. 7 along the attachment portion 72. The garment 14 is then rolled toward the carrier 12 as illustrated in FIG. 8 until the garment reaches the attachment portion 72, whereupon the rolled garment 14 is then slipped into the main compartment 22, as illustrated in FIG. 9. The closure mechanism 24 may then be closed so as to store the garment 14 within the compartment 22, as shown in FIG. 1. The carrier 12 may then be reattached by belt members 30 and 32 about the mid-section of the user 38, as illustrated in FIG. 2, with the carrier 12 being utilized as a traditional fanny pack, with a secondary compartment 40 being fully accessible, until such time as use of the garment 14 is once again desired.

While the embodiment shown herein has the back of the garment connected within the compartment of the carrier, it is within the teaching of the present invention for a person to wear the carrier in the front of their body, as fanny packs are sometimes carried, and to therefore attach the front of the garment within the compartment of the carrier.

As noted above, the material for the outerwear garment 14 may be of any desired type material but is preferably light weight material such as nylon or light weight fleece. It may be impermeable barrier material or porous depending upon the environment in which the garment 14 is designed to be utilized. Depending on the material selected for the garment 14, the size dimensions of the carrier 12 will be adapted to fit garment 14 when it is in its folded position.

As can be seen from above, the combination carrier and outerwear garment device of the present invention providing a unique article particularly useful for individuals who are engaged in outdoor activities. The invention provides a mid-section supported backpack for carrying various articles as well as provides for a permanently available single outerwear garment in the event an individual is exposed to a change in weather requiring the use of such a garment. Consequently, such garments need not be packed separately, but rather are inherently part of the carrier itself. When in the form of a raincoat, the outerwear garment 14 is readily available for people exposed to the elements, but not wishing to carry a separate raincoat. When in the form of a wind breaker, the device of the invention provides for a fanny pack type of carrier and also provides for a warm wind breaker should the weather become unexpectedly cool. Thus, the present invention obviates the necessity of individuals having to remember to carry separate garments or to make such garments available as well as eliminating the nuisance of carrying such garments in separate containers. Further, the outerwear garment 14 is contained in a stored, out of the way position so as not to be lost or to interfere with access to other articles or items stored in the carrier pack. As a result, the present invention provides highly convenient accessibility to a single outerwear garment as well as to a fanny pack type of carrier.

The foregoing description and the illustrative embodiments of the present invention have been described in detail in varying modifications and alternate 6 embodiments. It should be understood, however, that the foregoing description of the invention is exemplary only, and that the scope of the invention is to be limited only to the claims as interpreted in view of the prior art. Moreover, the invention illustratively disclosed herein, may be practiced in the absence of any element which is not specifically disclosed herein.

We claim:

1. A combination carrier pack and a single outerwear garment comprising;

a pack member adapted to be secured to the mid-section of a person, said pack member having a front portion, a back portion, and first and second opposed end portions, said end portions having an external portion, and a compartment having an opening, an inner front and back surface defined therewithin, and an outer front and back surface defined therewithout;

belt means attached to said external end portions of said pack so that said belt means are substantially always outside of said pack compartment, said belt means being adapted for removable attachment of said pack member about the mid-section of a person;

a single outerwear garment adapted to be worn about the upper body torso of a person, said garment having front and back panels, no such panels forming any substantial portion of said pack member, a mid-section, and an outer surface; and means for integrally joining a portion of said mid-section of said the outer surface of said single outerwear garment to a portion of said inner surface of said pack member to enable said single outerwear garment to be secured to and folded into said pack compartment for storage, whereby said pack and belt member may serve to releasably secure said single outerwear garment about the mid-section of a person when said single outerwear garment is folded into said compartment for storage without everting said compartment, and also to enable said single outerwear garment to be worn by a person while said garment carries said pack on the exterior of said garment and said belt member on the exterior of said compartment.

2. The combination as claimed in 1, wherein said pack compartment is closeable, and means for releasably closing and opening said compartment are provided at the opening of said compartment.

3. The combination as claimed in claim 2, wherein said pack member further includes a second closeable compartment disposed along said pack front portion, said pack back portion being adapted for positioning against the back side of a person wearing said pack member.

4. The combination as claimed in claim 3, wherein said second closeable compartment further includes releasable second closure means, said second closure means and second compartment being fully accessible when said carrier pack is worn about the mid-section of a person whether said a single outerwear garment is out of the pack compartment, or is in a stored position within said pack member.

5. The combination as claimed in 1, wherein said belt means is comprised of first and second belt members, each of which have proximal ends and distal ends, said proximal ends being attached, respectively, to said first and second opposed external pack end portions.

6. The combination as claimed in 5, wherein said first and second belt members include interconnecting fastening means disposed at said distal ends thereof for removable attachment of said pack member about the mid-section of a person.

7. The combination as claimed in 1, wherein said means for integrally joining a portion of said mid-section of said outer surface of said single outerwear garment to a portion of said inner surface of said pack member, are means for permanently securing the outer surface of said back panel to the interior surface of said compartment.

8. The combination as claimed in 7, wherein said means for permanently integrally joining a portion of said mid-section of said outer surface of said single outerwear garment to a portion of said inner surface of said pack member, are proximate to said closure means.

9. The combination as claimed in 8, wherein said integral joining means comprises stitching interconnecting said back panel of said garment to said inner back surface of said compartment.

10. The combination as claimed in claim 9, wherein said inner back surface of said pack member compartment is stitched to said back panel of said mid-portion of said single outerwear garment.

11. The combination as claimed in 1, wherein said means for integrally joining a portion of said mid-section of said outer surface of said single outerwear garment to a portion of said inner surface of said pack member, are proximate to said closure means.

12. The combination as claimed in claim 1, wherein said means for releasably closing and opening said compartment includes a zipper closure.

13. The combination as claimed in claim 1, wherein said pack member is secured to said back panel of said mid-portion of said single outerwear garment.

14. A single upper torso outerwear garment combined with an integral storage carrier comprising;

a single upper torso outerwear garment having a front portion, a back panel, a mid-portion for surrounding the mid-section of a user, and an upper portion to cover the torso of a user;

a carrier pouch having front and back sides, upper and lower portions, and oppositely disposed end portions defining an internal pocket therewithin, said end portions having an external portion, no such portions of said pouch being provided by any substantial portion of said garment, said pouch including means for selective closure of said internal pocket;

first and second belt portions, each of which have proximal ends and distal ends, each having one end proximal end attached, respectively, to one said pouch external end portion so that said belt portion ar substantially always outside of said internal pocket, the distal ends of said first and second belt portions including mating fastening means to permit said pouch to be secured about the mid-section of a user; and means for integrally securing the back panel of said single upper torso outerwear garment at said mid-portion to said carrier pouch to enable said pouch and belt portions to encircle the mid-section of a user when said single upper torso outerwear garment is worn by the user, and to enable said single upper torso outerwear garment to be folded into the pocket of said pouch for storage without eversion of said pouch, and so that it may then be carried about the mid-section of the user.

15. The single upper torso outerwear garment as claimed in claim 14, wherein said outerwear single upper torso outerwear garment further includes a lower portion extending below said mid-portion.

16. The single upper torso outerwear garment as claimed in claim 14, wherein said closure means comprises a zipper closure.

17. The single upper torso outerwear garment as claimed in claim 14, wherein said integral securing means attaches said back panel of said outerwear single upper torso outerwear garment to said upper portion of said inner surface of said pocket proximate to said closure means.

18. The single upper torso outerwear garment as claimed in claim 14, wherein said integral securing means comprises stitching which attaches the back panel of said outerwear single upper torso outerwear garment to the interior of said pocket at the back side of said pouch.

19. A belt-supported pack and outerwear garment device, said pack being adapted to be worn around the mid-section of a person, whether said outerwear garment is in an expanded condition wearable by a person or in a folded condition stored within said pack, said device comprising:

a flexible pack including a closeable main compartment, said pack having first and second external end portions;

closure means for the opening of said main compartment;

first and second belt members secured, respectively, to said first and second external end portions so that said belt portions are substantially always outside of said main compartment, said belt members each having a free distal end;

fastener means disposed at the distal ends of said belt members for releasably and adjustably securing said free ends together;

an outerwear garment to cover the torso and mid-section of a person, said outerwear garment including a back panel, with no portion of said garment forming any substantial portion of said pack; and means for securing the back panel of said outerwear garment to said pack to permit said pack to be worn about the mid-section of a person as a belt for said garment and to permit folded storage of said garment in said main compartment, without the need to evert said main compartment, as said pack is worn about a person's mid-section.

20. The device as claimed in claim 19, wherein said outerwear garment back panel is secured to the interior of said main compartment proximate to the opening thereof.

21. The device as claimed in claim 19, wherein said outerwear garment is comprised of a barrier material adapted for wearing over clothing.

22. The device as claimed in claim 19, wherein said outerwear garment comprises a raincoat.

23. The device as claimed in claim 19, wherein said outerwear garment comprises a wind breaker.

* * * * *